United States Patent [19]

Draney

[11] 4,164,982

[45] Aug. 21, 1979

[54] VIBRATORY CABLE PLOW ASSEMBLY

[75] Inventor: Robert G. Draney, Wichita, Kans.

[73] Assignee: J. I. Case Company, Racine, Wis.

[21] Appl. No.: 881,219

[22] Filed: Feb. 27, 1978

[51] Int. Cl.[2] ..... E02F 5/02; F16L 1/00

[52] U.S. Cl. ..... 172/40; 37/DIG. 18; 405/182

[58] Field of Search ..... 172/40; 37/193, DIG. 18, 37/98; 405/182

[56] References Cited

U.S. PATENT DOCUMENTS

| | | | |
|---|---|---|---|
| 3,618,237 | 11/1971 | Davis | 172/40 X |
| 3,757,869 | 9/1973 | Gagne | 172/40 |

FOREIGN PATENT DOCUMENTS

| | | | |
|---|---|---|---|
| 962837 | 2/1975 | Canada | 37/DIG. 18 |
| 2652734 | 12/1977 | Fed. Rep. of Germany | 172/40 |

*Primary Examiner*—Paul E. Shapiro

*Attorney, Agent, or Firm*—Cullen, Sloman, Cantor, Grauer, Scott & Rutherford

[57] ABSTRACT

The disclosed cable plow assembly is adapted to reduce the power requirements of cable and line laying plows. The plow blade is suspended on the rear of a resilient frame assembly having two pair of vertically spaced links. Each link is pivotally supported on forward and rear frame members by resilient torsional bushings. The links of each pair preferably converge toward the direction of movement of the plow or the supporting vehicle at an angle of about fifteen to twenty degrees or about three to four horizontal units to one vertical. This arrangement generates a unique forward elliptical cleaving action in the plow blade, reducing the force required to cut the earth and pull the blade through the ground. In the most preferred embodiment, the forward ends of the lower links of each pair are adjustable vertically to adjust the angle between the links and thereby adjust the elliptical motion of the plow blade to accommodate various soil conditions.

12 Claims, 3 Drawing Figures

FIG. 2
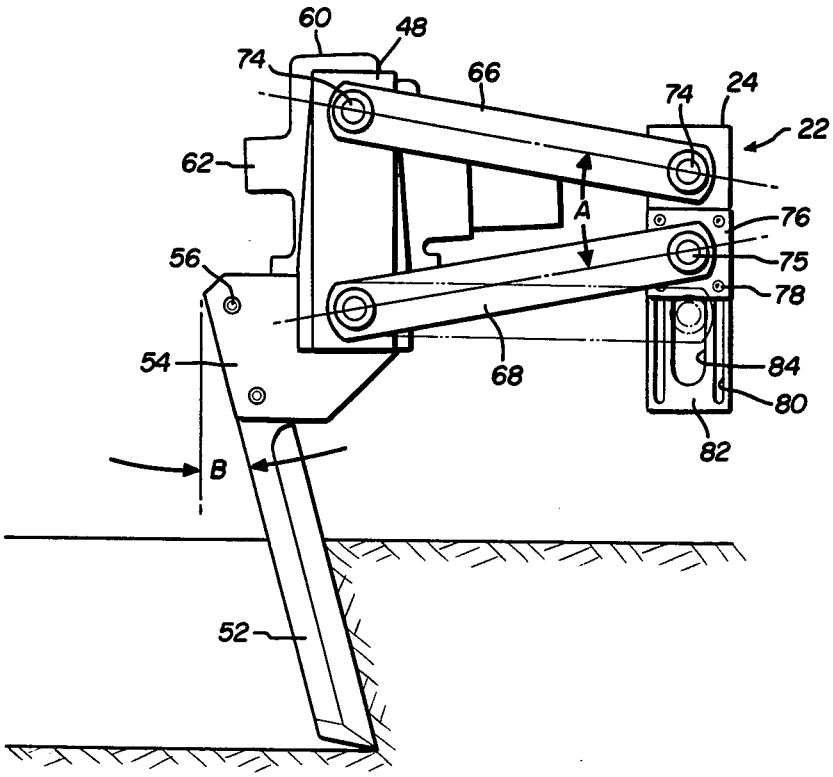
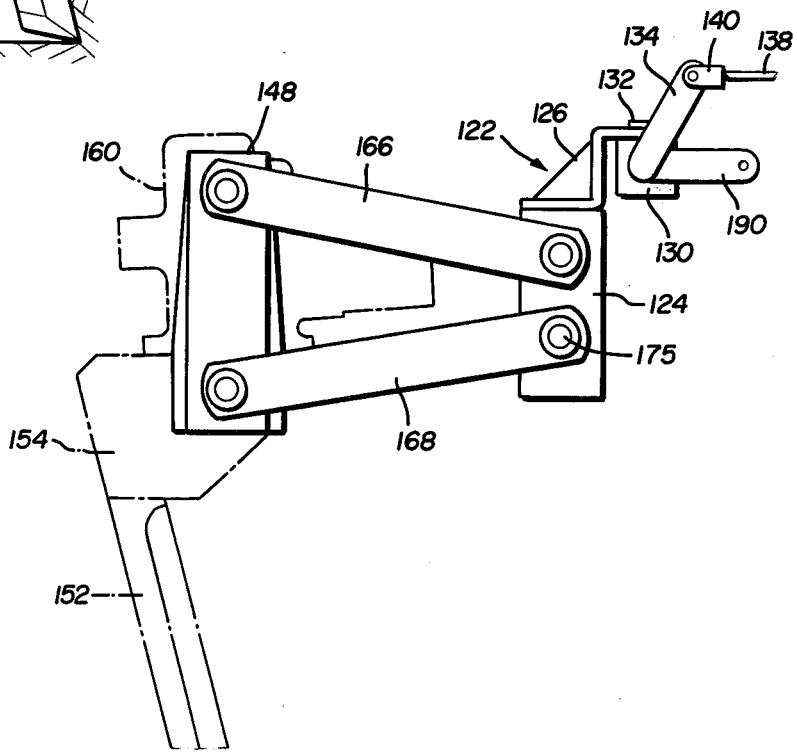
FIG. 3

VIBRATORY CABLE PLOW ASSEMBLY

FIELD OF THE INVENTION

The disclosed vibratory plow assembly is adapted to laying cable, flexible pipe and the like underground in the cut made by the blade. The blade is vibrated to reduce the drawbar pull or the force required to pull the blade through the ground. More particularly, the disclosed invention relates to a resilient frame assembly for a vibratory plow which generates a unique forward elliptical cleaving action in the plow blade.

DESCRIPTION OF THE PRIOR ART

Vibratory cable plows of the type disclosed herein have been used for several years to lay cable, flexible pipe and the like underground. The cable or pipe may be either pulled through the cut of the plow blade or a cable chute may be provided on the following or trailing edge of the plow blade which guides the cable or pipe into the ground from a drum mounted on the tractor or other vehicle. Various types of vibrators have been mounted on the plow blade or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the instant application.

The preferred frame assembly of the prior art, as shown in the above referenced patents, includes two pair of parallel side links which are resiliently supported by pivotal connections to forward and rearward frame members comprising generally vertical stantions or columns. The frame linkage assembly thus defines two parallelograms. The plow blade and vibrator are supported by the rearward frame members. The vibrator thus generates substantially vertical vibration in the plow blade when the vehicle is stationary and orbital vibration in the blade as the blade is pulled through the ground. In the frame assembly disclosed in U.S. Pat. No. 4,040,261, the vibrator is suspended from the rearward frame members by a U-shaped yoke and the yoke is connected to the vertical plow blade by a pivotal link which generates an oribtal motion in the blade.

It has now been discovered that a forwardly moving elliptical cleaving action in the blade will substantially reduce the force required to cut the earth and pull the blade through the ground. This preferred motion is generated in the vibratory cable plow of the present invention in a simplified resilient frame assembly as described hereinbelow.

SUMMARY OF THE INVENTION

As described, the vibratory plow assembly of this invention is adapted to lay an elongated element such as a cable or flexible pipe underground in the cut made by the plow blade. The invention is sometimes referred to as a cable plow assembly for simplification of description only. The assembly includes a resilient plow frame for mounting the plow on a ground traversing vehicle, such as a tractor, bulldozer or the like. The preferred frame assembly includes a forward frame member, laterally spaced side frame members and a rearward frame member which supports the elongated cable plow and the vibrator. The side frame members preferrably comprise a pair of generally vertically spaced elongated links which converge in spaced relation toward the forward frame member and the vehicle at an acute angle of about fifteen to twenty degrees. The forward and rearward ends of each link are pivotally connected to the forward and rearward frame members, respectively. The motion in the blade about the pivotal connections is elliptical, which substantially reduces the forces required to cut the earth and pull the blade through the ground.

In the most preferred embodiment of the invention, at least one forward pivotal connection of each pair of links is adjustable vertically relative to the pivotal connection of the other side link, such that the relative angle between the links of each pair of links maybe adjusted to vary the elliptical arc generated in the blade by the vibrator, to accommodate various soil and ground conditions. For example, the angle between the links of the side frame members may be adjusted to about fifteen degrees to provide maximum forward cleaving motion in difficult conditions, such as hard clay and packed roots. The angle between the frame members may then be increased to increase the vertical component of the vibration in relatively soft soil. In the disclosed embodiment of the adjustable frame assembly of this invention, the lower link of each pair of side links is pivotally connected to a slide member and the forward frame member includes vertically extending tracks which slideably receive the slide members for vertical adjustment of the lower link pivotal connections. The slides and therefore the angle between the links of each pair may be fixed in any desired position to accommodate various ground conditions.

Other advantages and meritorious features of the present invention will be more fully understood from the following description of the preferred embodiments, the appended claims and the drawings, a brief description of which follows.

BRIEF DESCRIPTION OF THE DRAWINGS

FIG. 2 is a side elevation of the plow frame assembly shown in FIG. 1;

FIG. 3 is a side elevation of a vibratory cable plow frame, similar to FIG. 2, of another embodiment of this invention.

DESCRIPTION OF THE PREFERRED EMBODIMENTS

Figure 1:
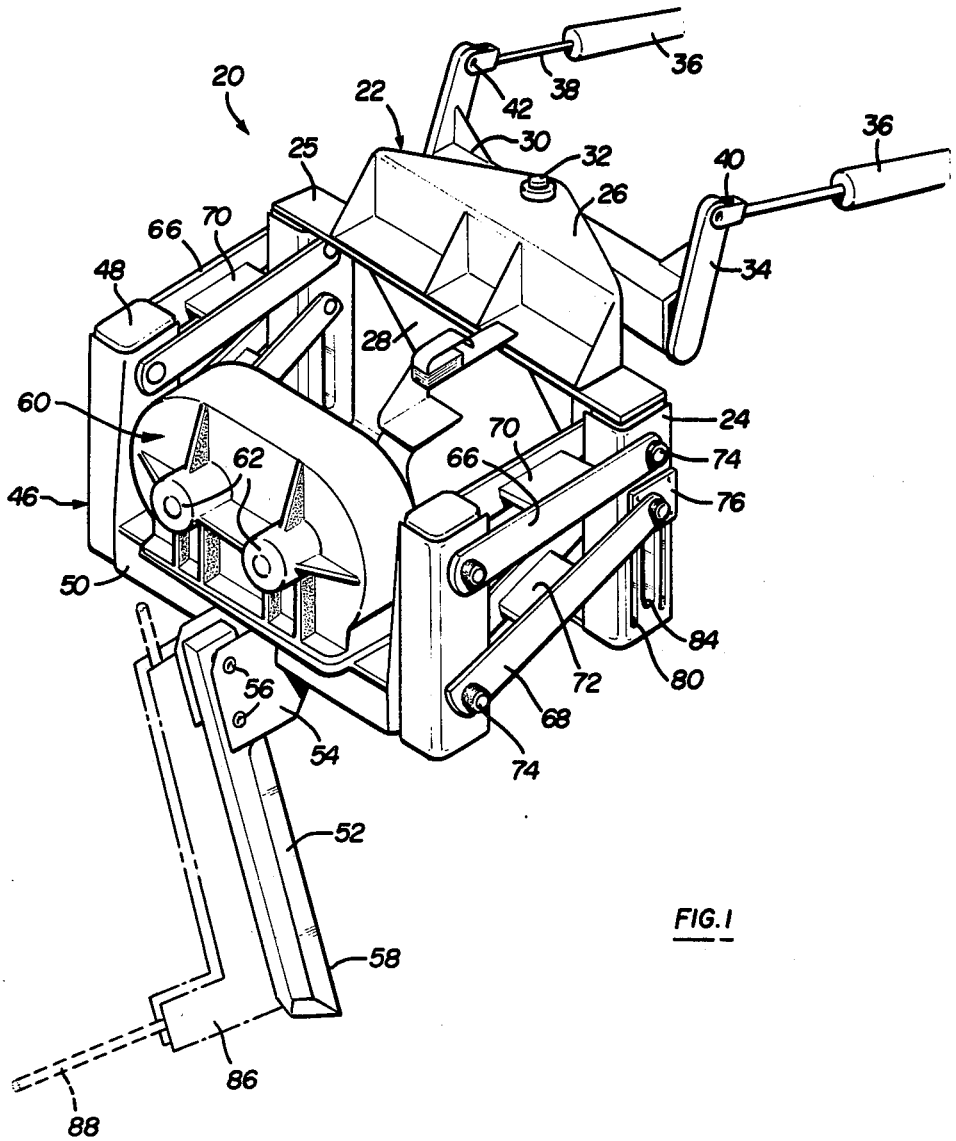
FIG. 1 is a perspective view of one embodiment of the vibratory cable plow of this invention.

The cable plow frame assembly 20 of this invention is best shown in FIG. 1 and includes a forward frame assembly 22 which is supported on the rear of a vehicle, not shown, such as a tractor, bulldozer or the like. The disclosed embodiment of the forward frame assembly includes two generally parallel vertical columns 24 which are interconnected by horiztonal plates 25 and horizontal frame member 26. The horizontal frame members are supported by vertical frame members 28 and columns 24. Horiztonal frame member 26 is supported on horizontal beam 30 by upright pin 32 for movement of the cable plow assembly relative to the vehicle. In the disclosed embodiment, the transverse beam 30 includes upwardly extending arms 34 which are connected to the vehicle by hydraulic rams 36. The cylinder portions of rams 36 are pivotally connected to the vehicle, not shown, and the rod portions 38 include bifurcated ends 40 which are pivotally secured to arms 34 by pins 42. As disclosed in the above referenced U.S.

Pat. No. 3,618,237, which in incorporated herein by reference, the horizontal beam 30 is connected to and supported by pivotal links, not shown. Thus, simultaneous extension of fluid rams 36 lowers the frame assembly into operating position with the blade in the ground. Simultaneous retraction of the hydraulic rams 36 raises the frame assembly for transportation.

The rearward frame assembly 46 in the disclosed embodiment include two generally vertical columns 48 and a support plate assembly 50 which may wrap around the vertical columns and which extends between the columns to support the blade 52. The blade is supported on the support plate by transverse parallel plates 54 and bolts 56. The blade 52 is generally flat having a forward or leading cutting edge 58. A vibrator 60 is supported on the transverse support plate 50 by bolts or the like, not shown. Various types of vibrators or shakers may be utilized to generate vibration in the blade 52 and reduce the drawbar pull or the force required to pull the blade through the ground.

In the preferred embodiment of the vibratory cable plow of this invention, the forward and rearward frame assemblies are resiliently interconnected by two pair of pivotal links, including two upper links 66 and two lower links 68. In the disclosed embodiment, the links are constructed of two parallel plates interconnected by a web portion 70 and 72, respectively. The links are pivotally connected to the upright columns 24 and 48 by resilient torsional bushings 74. The torsional bushings may be identical to the torque cushioning element disclosed in the above referenced prior U.S. Pat. No. 3,618,237. The bushings are designed to absorb vibrations while permitting limited pivotal movement of the connected parts. The blade 52 and vibrator 60 are thus resiliently suspended on the rear frame assembly 46 for vibrational movement relative to the forward frame assembly 22 and the supporting vehicle. In the disclosed embodiment, the vibrator 60 includes two eccentric weights which rotate about shafts 62. The weights may be "timed" to provide various movements. Generally, the weights are oppositely timed and rotate in opposite directions to provide generally vertical vibration. This vibration will create the preferred elliptical motion in the blade with the plow frame assembly of this invention as described hereinbelow.

As best shown in FIG. 2, the links 66 and 68 converge toward the forward frame assembly 22. In the preferred embodiment, the angle "A" between the links is adjustable to accommodate various soil conditions. In the disclosed embodiment, the forward pivotal connections 75 of the lower links 68 are connected to vertical slides 76. The slides include bolts 78 which are received in slots 80 in plate 82 of vertical columns 24. The torsional bushing 75 is received through opening 84 in the plate and column. The torsional bushing 75 may thus be adjusted vertically relative to the bushing 74 of upper link 66, thereby adjusting the angular relation between the links.

As described above, the links 66 and 68 of each pair of links preferrably converge in spaced relation toward the forward frame member and thus the vehicle. The most preferred angle "A" will depend upon the ground conditions and, to a lesser extent, the attack angle "B" of the blade. The attack angle being measured between the angle of the blade and vertical. It has been discovered that the most preferred angle for all ground conditions is between about fifteen and twenty degrees or about three to four units horizontal to one unit vertical. For example, with the links set at a relative angle of about sixteen degrees (3.4 units horizontal to one vertical), the time required for the vibratory plow to cut a two-hundred foot slot was reduced thirty-nine percent (39%) compared to paraellel links over the same ground. Where the angle was reversed (i.e. the links converge toward the rearward frame assembly) the time was longer than for parallel linkage. Where the ground is relatively soft however, such as sand, the angle "A" may be increased to provide a greater vertical component for the vibration. With the links 66 and 68 set parallel, the vertical component of the vibrations generated by the shaker will be substantially greater than where the links converge as shown in FIGS. 2 and 3. For example, where the shaker or vibrator force is 12,600 pounds vertical with the weights timed as described above, the vertical component of the vibration will be 10,400 pounds and the horizontal force will be about 2,200 pounds. With the links set as shown in FIG. 2, the horizontal force will increase to about 9,200 pounds. Further, the elliptical cleaving action generated in the blade will break up hard ground, reducing the forces required to pull the blade through the ground and the hydraulic forces.

As described above, the vibratory cable plow of this invention may be utilized to lay cable, flexible pipe and other elongated elements underground. The cable or pipe may be pulled through the slot cut by the blade simply by attaching the cable or pipe to the trailing edge of the blade. Alternatively, a cable chute 86 may be attached to the trailing edge of the blade which receives the cable or pipe 88. Generally, the cable is received from a drum rotatably supported on the vehicle as described in the above referenced prior art patents.

The embodiment of the vibratory cable plow shown in FIG. 3 differs from the embodiment of FIG. 2 in that the torsional bushings 175 of the lower links are fixed to the vertical columns 124 of the forward frame assembly. The angle between the links 166 and 168 are thus retained at a preferred angle of between about fifteen and twenty degrees. FIG. 3 also includes further details of the connection between the forward frame assembly 122 and the vehicle, not shown. As described, the horizontal frame member 126 is secured to horizontal beam 130 by pin 32. Beam 130 includes upwardly extending arms 134 which are connected by a clevis 140 to piston rods 138. The beam is also connected to the vehicle by pivot links 190. As will be noted, the elements of the fixed vibratory plow of FIG. 3 have been numbered in the same sequence as the elements of the adjustable vibratory plow of FIG. 2.

In either embodiment of the invention, the links 66 and 68 or 166 and 168 of each pair of side links converge at an acute angle toward the forward frame assembly and therefore the vehicle, not shown, to generate an elliptical ground cleaving motion in the blade. This motion is generated by the vibrator 60, 160 about the torsional bushings 74 and 75, 174 and 175. The unique elliptical motion of the blade substantially reduces the forces required to pull the blade through the ground or the drawbar pull and the hydraulic forces of plowing. Further, the adjustable link embodiment of FIGS. 1 and 2, permits adjustment of the angle "A" between the links to accommodate various ground conditions providing an additional advantage for the vibratory cable plow of this invention.

It will be understood that various modifications may be made to the vibratory cable plow of this invention without departing from the purview of the appended claims. For example, various vibrators or shakers may be utilized and the structure of the forward and rearward frame assemblies may be modified to accommodate various shakers and plow designs.

I claim:

1. A vibratory cable plow, including a ground traversing vehicle, a plow frame supported behind said vehicle and an elongated, generally vertically extending blade supported on said frame, said frame having two laterally spaced pair of rearwardly extending elongated frame links, one pair of vertically spaced links of each side of said frame, the forward ends of each pair of said links being pivotally supported by said vehicle, the rearward ends of each pair of said links being pivotally connected in vertically spaced relation to a rear frame member, a vibrator and said blade suspended and supported on said rear frame member such that said blade is vibrated relative to said vehicle, each pair of said links converging in spaced relation toward said vehicle at an angle of about three to four units horizontal to one unit vertical, such that the forward cutting edge of said blade is vibrated in an elliptical ground cleaving motion reducing the forces required to cut the ground and pull the blade through the ground.

2. The vibratory cable plow defined in claim 1, characterized in that one said forward end of each pair of said frame links is adjustable vertically relative to the other link of said pair, such that the angle between the links of each pair may be adjusted to vary the elliptical arc generated in said blade.

3. The vibratory cable plow defined in claim 1, characterized in that said forward ends of said frame links are pivotally connected to a forward frame member supported in fixed relation by said vehicle, one said forward end of each pair of links being adjustably connected to a generally vertical track on said forward frame member permitting vertical adjustment of said link ends relative to the vertically opposed link, thereby adjusting the relative angle between each pair of links to vary the elliptical arc generated in said blade to accommodate various ground conditions.

4. The vibratory cable plow defined in claim 3, characterized in that the lower link of each said pair of frame links is pivotally connected to a slide, said forward frame member having vertical tracks which receive said slides for vertical adjustment of the forward ends of said links and adjustment of said angle between said links in each pair.

5. The vibratory cable plow defined in claim 4, characterized in that said pivotal link connections each include resilient torsional bearings resiliently supporting said blade for vibratory movement.

6. A vibratory cable plow assembly, comprising a frame to be supported behind a vehicle, a generally vertical elongated plow blade and a vibrator supported on said frame, one said pair of vertically spaced links on each side of said frame, the rear ends of each pair of said links being pivotally connected in vertically spaced relation to a rear frame member, said blade and vibrator suspended on said rear frame member between said links, the forward ends of each pair of said links being pivotally connected in vertically spaced relation to a forward frame member, the forward pivotal connections of one of each pair of links being adjustable vertically on said forward frame member for adjusting the relative angle between the links of each pair and the elliptical arc of vibration generated in said blade by said vibrator about said space link pivotal connections.

7. The vibratory cable plow assembly defined in claim 6, characterized in that the lower link of each said pair of side links is pivotally connected to a slide member, said forward frame member having generally vertically extending tracks which slideably receive said slide members for vertical adjustment of said pivotal connects and adjustment of the relative angle between each pair of side links.

8. The vibratory cable plow assembly defined in claim 7, characterized in that said pivotal connections each include a resilient torsional bearing resiliently supporting said links in the defined angular relation and said vibrator moving said blade through the ground in the preferred elliptical arc.

9. The vibratory cable plow assembly defined in claim 7, characterized in that said lower links of each pair of links may be securred to said forward frame member at an angle of about fifteen to twenty degrees relative to the opposed link of said pair.

10. A vibratory plow assembly for laying an elongated element underground comprising, in combination, a resilient frame assembly to be mounted on a ground traversing vehicle, said frame assembly having a forward frame member mounted on said vehicle, side frame members on each side of said frame resiliently supported on pivotal connections on said forward frame member, a rearward frame member resiliently supported by said side frame members on resilient pivotal connections, a generally vertical plow blade and a vibrator shaker means supported on said rearward frame member, such that said plow blade is vibrated by said shaker means about said resilient pivotal connections, the improvement comprising: said side frame members each including two generally vertically spaced elongated links converging in spaced relation toward said forward frame member and said vehicle at an acute relative angle of about fifteen to twenty degreees, the forward and rearward ends of each link pivotally connected respectively to said forward and rearward frame members, said vibrator shaker means thereby generating an elliptical ground cleaving motion in said blade about said pivotal connections.

11. The vibratory plow assembly defined in claim 10, characterized in that the attack angle of said blade is about fifteen degrees, the attack angle being the angle defined by said blade relative to vertical.

12. The vibratory plow assembly defined in claim 10, characterized in that at least one forward pivotal connection of each pair of side frame members links is adjustable vertically relative to the pivotal connection of the other side frame link, such that the relative angle between the links of each side frame member is adjustable to vary the elliptical arc generated in said blade by said vibrator shake means.

* * * * *